United States Patent [19]

Greskovics et al.

[11] Patent Number: 4,734,954

[45] Date of Patent: Apr. 5, 1988

[54] POOL SCRUBBER DEVICE

[76] Inventors: Paul Greskovics, 432 28th St., Manhattan Beach, Calif. 90266; Donald R. Chivens, 8526 Louise Ave., Northridge, Calif. 91325

[21] Appl. No.: 17,477

[22] Filed: Feb. 24, 1987

[51] Int. Cl.[4] ..... F04H 3/20; A46B 13/06

[52] U.S. Cl. ..... 15/1.7; 15/29; 15/50 R; 114/222

[58] Field of Search ..... 15/1.7, 49 R, 50 R, 15/50 C, 143 A, 98, 29; 51/177, 170 T; 114/222

[56] References Cited

U.S. PATENT DOCUMENTS

| | | | |
|---|---|---|---|
| Re. 26,741 | 12/1969 | Myers . | |
| 214,569 | 4/1879 | Jennings . | |
| 661,277 | 11/1900 | Rix . | |
| 1,635,474 | 7/1927 | Gillis | 51/177 X |
| 2,672,634 | 3/1954 | Burnham | 51/177 X |
| 3,020,573 | 2/1962 | Descarries | 15/49 R |
| 3,606,631 | 9/1971 | Vassh et al. . | |
| 3,906,574 | 9/1975 | Kaeser . | |
| 3,928,947 | 12/1975 | Millett | 15/1.7 X |
| 4,084,281 | 4/1978 | Smith . | |
| 4,084,535 | 4/1978 | Rees . | |
| 4,103,381 | 8/1978 | Schulz et al. . | |
| 4,129,904 | 12/1978 | Pansini . | |

FOREIGN PATENT DOCUMENTS

| | | | |
|---|---|---|---|
| 583489 | 9/1959 | Canada | 15/50 R |
| 2729233 | 1/1979 | Fed. Rep. of Germany | 15/50 R |
| 2501745 | 9/1982 | France | 15/29 |

*Primary Examiner*—Edward L. Roberts

*Attorney, Agent, or Firm*—Kelly, Bauersfeld & Lowry

[57] ABSTRACT

A water-driven scrubber device is used particularly in scrubbing wall and floor surfaces of a swimming pool or the like. The scrubber device comprises a compact housing adapted for connection to a supply of water under pressure and encasing a water-driven turbine wheel in combination with reduction gear elements for rotatively driving removable scrubber members, such as brushes. In one operational mode, a mounting yoke is carried by the housing for connection to a standard pool service utility pole to manipulate the scrubber device over pool surfaces, wherein the mounting yoke can be installed on the housing in either of two positions to permit or prevent pivoting motion relative to the housing, as desired. A retractable stabilizer wheel is also provided on the housing to facilitate accurate and smooth movement of the scrubber device over pool surfaces. In another operational mode, a portion of the housing defines a handle for easy grasping and direct manual movement of the scrubber device over pool surfaces.

19 Claims, 4 Drawing Sheets

FIG. 4
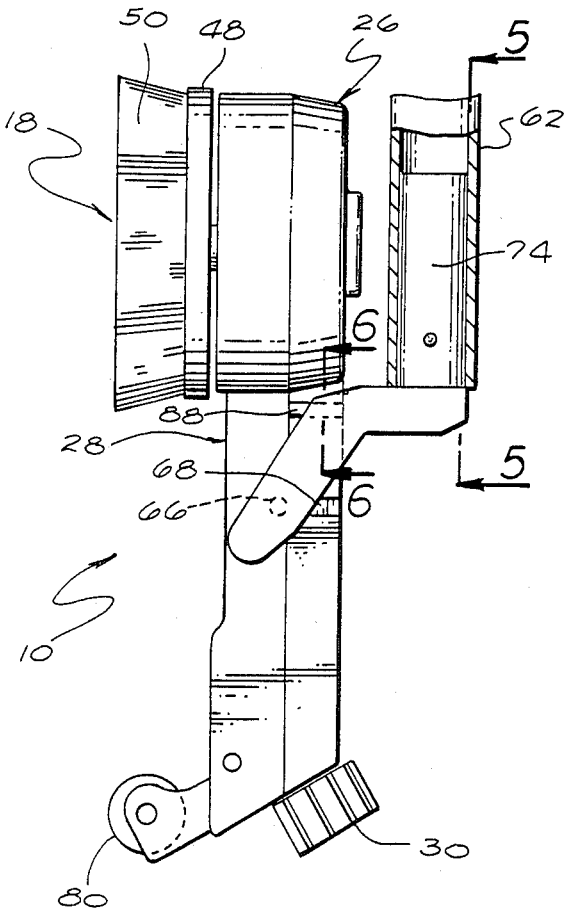
FIG. 5
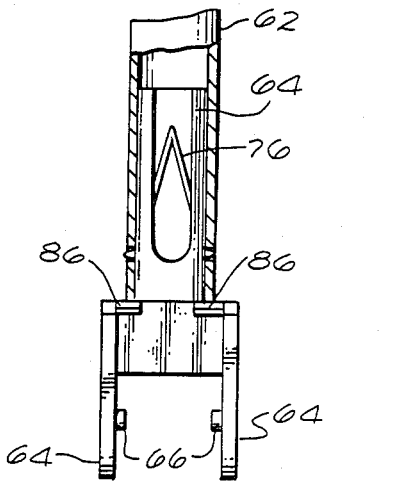
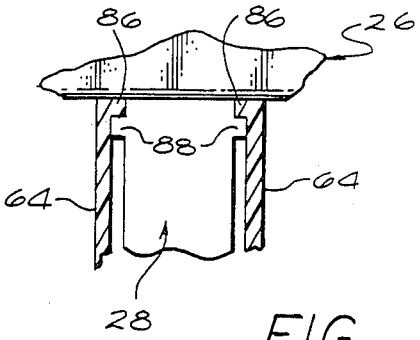
FIG. 6
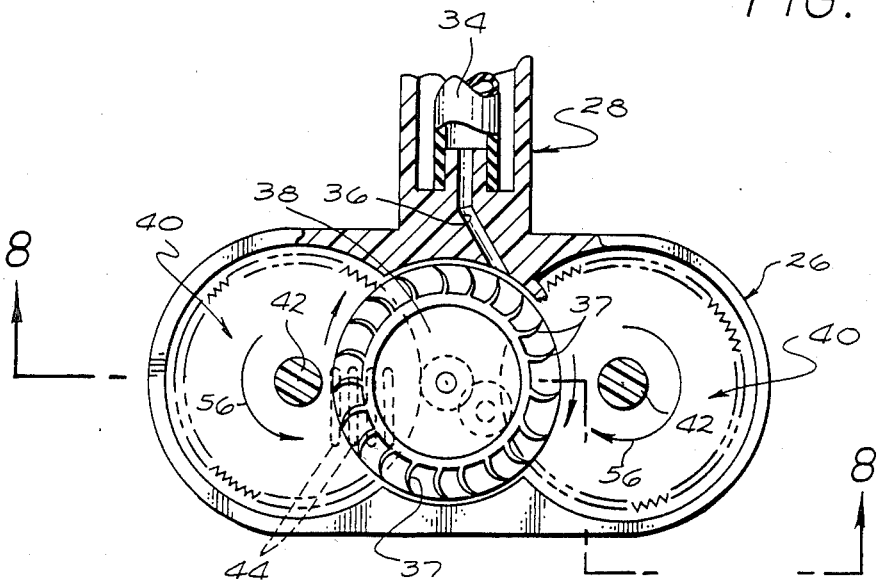
FIG. 7

FIG. 8
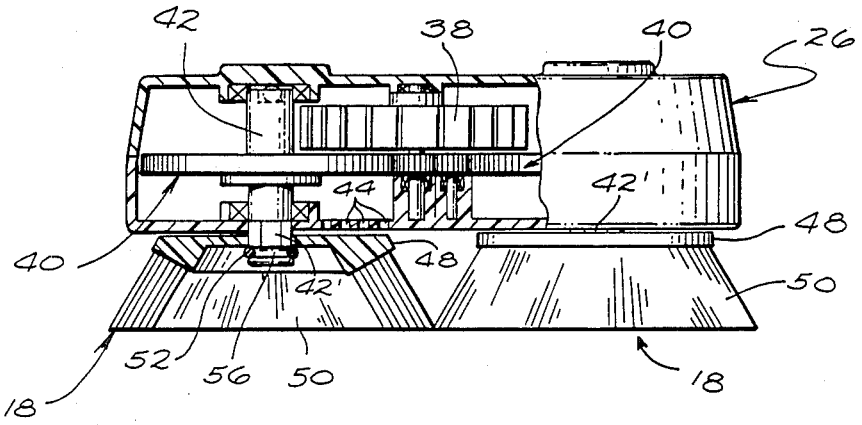
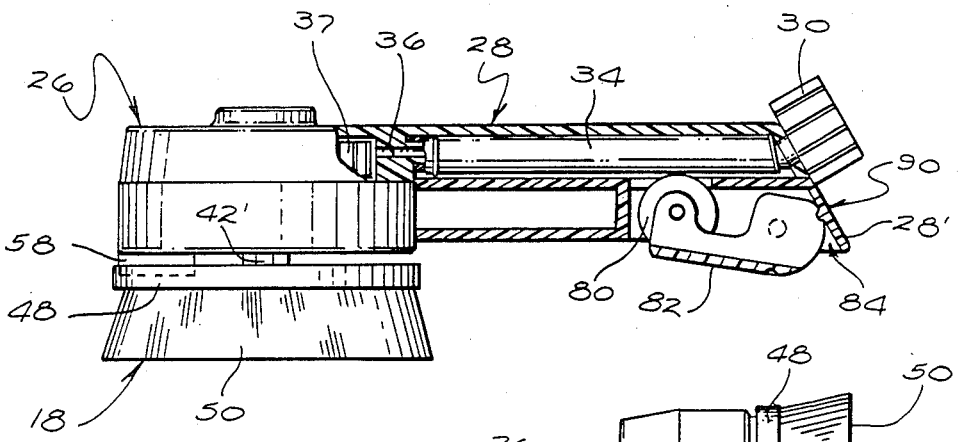
FIG. 9
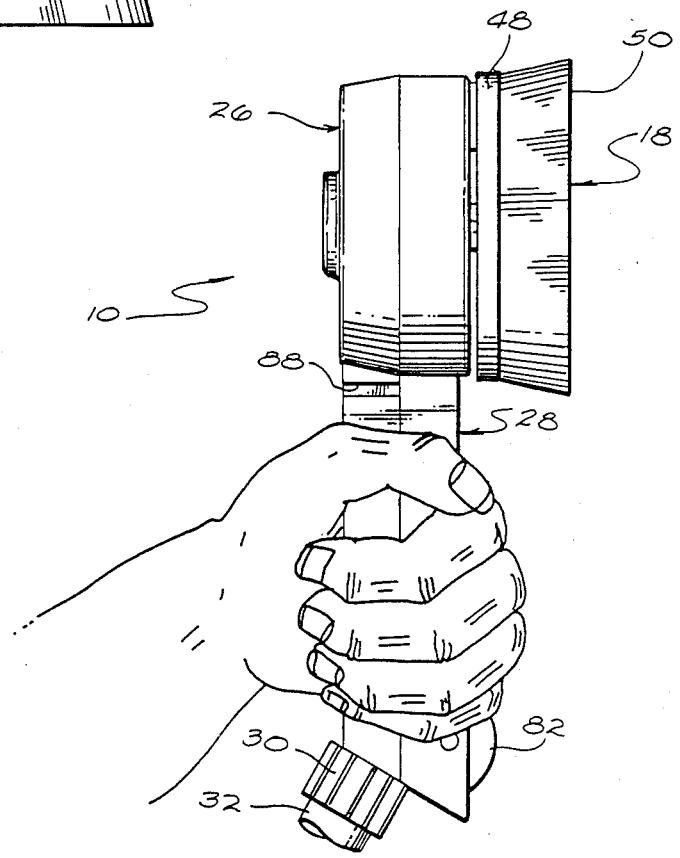
FIG. 10

POOL SCRUBBER DEVICE

BACKGROUND OF THE INVENTION

This invention relates generally to cleaning devices for use in scrubbing a variety of surfaces particularly such as the wall and floor surfaces of swimming pools and the like. More specifically, this invention relates to a relatively compact and easily operated scrubber device for use in performing a variety of otherwise difficult pool surface cleaning tasks.

Residential and commercial swimming pools and hot tubs and the like are well known in the art. Such swimming pools, hot tubs, etc., include a pool structure having a body of water confined therein, wherein the pool water is normally treated with chemicals for sanitation purposes. A filtration system is operated at frequent intervals to circulate the pool water through an appropriate filter unit which removes dirt and other water-suspended debris from the pool water, after which the water is recirculated to the pool. To maintain desired standards of water cleanliness and clarity, the filtration system in most residential and commercial swimming pools is operated on a daily schedule at least several hours each day.

Notwithstanding the provision and regular operation of pool water filtration systems, it is well known that additional cleaning procedures are necessary to maintain the pool water in a state of satisfactory cleanliness over a prolonged time period. For example, conventional water filtration systems do not remove non-suspended debris such as leaves, twigs, and other dirt and sediment which settles continuously onto the floor and wall surfaces of a swimming pool. Accordingly, periodic cleaning of the pool floor and wall surfaces is necessary, wherein such periodic cleaning may be performed manually using a so-called vacuum head connected to the intake side of the water filtration system, or by use of automatic pool cleaning equipment such as, for example, a water-powered cleaner device of the general types disclosed in U.S. Pat. Nos. 3,032,044; 3,822,754; and 4,558,579.

While the above-referenced pool surface cleaning devices are generally satisfactory for performing routine cleaning maintenance procedures, such cleaning devices are limited in the types of cleaning tasks which can be performed. More specifically, prior art pool cleaning devices generally rely upon the use of pressurized water jets or hydraulic vacuums to dislodge and/or remove debris settled upon submerged pool surfaes. As a result, such devices have insufficient power to perform occasional and more difficult cleaning tasks such as removing stains, algae colonies, and chemical deposits from pool surfaces. These more difficult cleaning tasks have, in the past, required substantial and difficult manual brushing of pool surfaces which are frequently at hard-to-reach locations.

There exists, therefore, a significant need for an improved pool cleaning device designed for use in performing otherwise difficult pool surface cleaning tasks, wherein the improved cleaning device avoids substantial manual power and is further adapted for convenient access to a wide range of different, normally hard-to-reach pool surfaces. The present invention fulfills these needs and provides further related advantages.

SUMMARY OF THE INVENTION

In accordance with the invention, an improved cleaner apparatus is provided for use in applying a vigorous scrubbing cleaning action to a variety of surfaces particularly such as the wall and floor surfaces of a swimming pool or the like. The improved cleaner apparatus or scrubber device includes water-driven scrubber members supported by a compact housing which is adapted for use in multiple operational modes to accommodate convenient and facilitated scrubbing of a variety of difficult-to-clean and/or hard-to-reach surfaces.

In the preferred form, the scrubber device housing defines a relatively compact head encasing a wate turbine wheel for rotatably driving reduction gear elements which are coupled in turn to the scrubber members in the form of brushes or the like disposed outside the head. The housing further defines a relatively narrow handle projecting outwardly from the head and including connector means such as a standard hose fitting for connection to a supply of water under pressure. A conduit extends from this hose fitting through the handle for guiding the water under pressure to a jet port within the head, wherein the water is discharged from this jet port for rotatably driving the water turbine wheel.

In one primary operational mode, a mounting yoke is attached to the handle and includes lock means for releasable connection to the end of a standard pool service utility pole of the type used commonly for manipulating brushes, leaf bags, etc., in the course of performing pool maintenance procedures. The mounting yoke is adapted for attachment to the scrubber device handle in a first position permitting pivoting motion of the mounting yoke through at least about ninety degrees to correspondingly permit smooth transitional movement of the scrubber device between generally horizontal floor and generally vertical wall surfaces of a swimming pool. Alternately, the mounting yoke is adapted for attachment to the handle in a second position preventing mounting yoke pivoting motion to correspondingly provide more precision control over scrubber device manipulation when required for certain cleaning tasks. A retractable stabilizer wheel at the distal end of the handle is normally deployed when the mounting yoke and utility pole are used for device manipulation, wherein the stabilizer wheel enhances the overall stability and accuracy of movement of the scrubber device within the pool water.

In an alternative operational mode, the housing handle can be grasped manually for ready manipulation of the scrubber device relative to pool surfaces. In this operating mode, the stabilizer wheel can be retracted to a substantially concealed position within the handle, and the mounting yoke can be pivoted to an out-of-the-way position or removed entirely from the housing, as desired.

Other features and advantages of the present invention will become more apparent from the following detailed description, taken in conjunction with the accompanying drawings which will illustrate, by way of example, the principles of the invention.

BRIEF DESCRIPTION OF THE DRAWINGS

The accompanying drawings illustrate the invention. In such drawings:

FIG. 4 is a side elevation view depicting the pool scrubber device in an alternative operating configuration;

FIG. 5 is a fragmented sectional view taken generally on the line 5—5 of FIG. 4;

FIG. 6 is an enlarged fragmented sectional view taken generally on the line 6—6 of FIG. 4;

FIG. 7 is a fragmented horizontal sectional view taken generally on the line 7—7 of FIG. 3;

FIG. 8 is a fragmented side elevational view taken generally on the line 8—8 of FIG. 7;

FIG. 9 is a fragmented side elevational view of the scrubber device; and

FIG. 10 is a side elevational view generally similar to FIG. 4 but depicting the scrubber device in still another operational mode.

DETAILED DESCRIPTION OF THE PREFERRED EMBODIMENT

Figure 1:
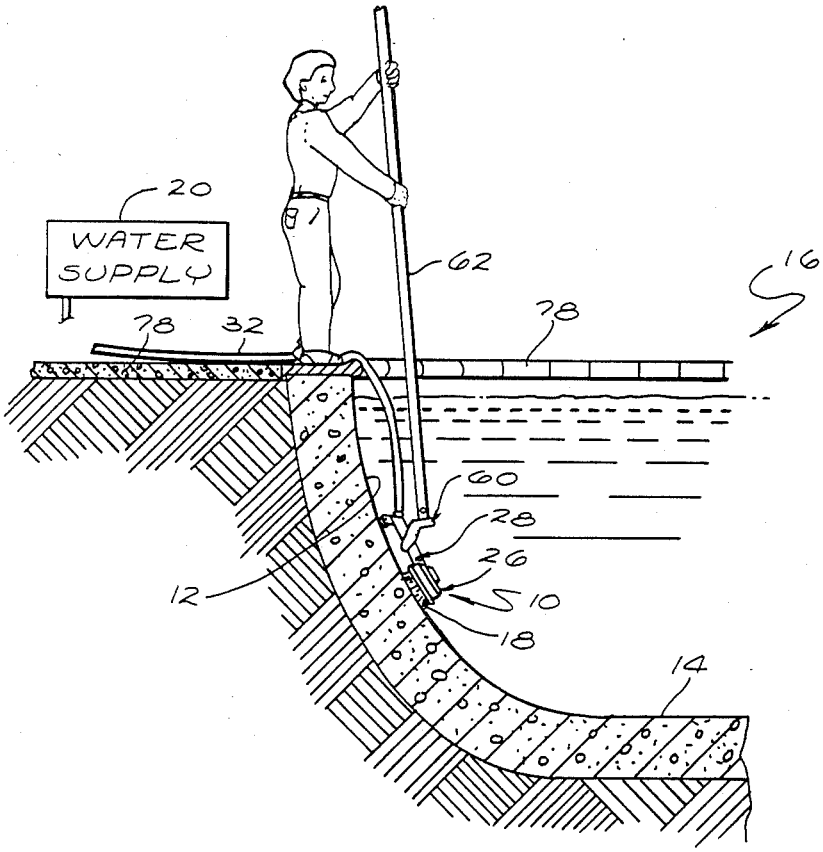
FIG. 1 is a fragmented and somewhat diagrammatic view depicting a pool scrubber device embodying the novel features of the invention and shown in use for cleaning surfaces of a swimming pool.

As shown in the exemplary drawings, a scrubber device referred to generally by the reference numeral 10 is provided for use in performing a variety of cleaning tasks, particularly such as cleaning wall surfaces 12 and the floor surface 14 of a swimming pool 16 or the like as viewed in FIG. 1. The scrubber device 10 is adapted for use in multiple operational modes for convenient and facilitated performance of pool surface cleaning tasks.

The improved pool surface scrubber device 10 of the present invention provides a relatively compact and easily operated apparatus designed to perform pool surface cleaning tasks which are otherwise not satisfactorily accomplished by other types of pool cleaning equipment. The scrubber device 10 utilizes scrubber members 18 driven hydraulically by coupling to a pressurized water supply 20, whereby the scrubber members 18 can be applied directly to the desired pool surface to provide a vigorous scrubbing action without requiring significant manual exertion. This vigorous scrubbing action is especially desirable and required for certain types of pool cleaning tasks, for example, removal of embedded stains, algae growths such as so-called "black" algae, accumulated chemical deposits and the like. More importantly, the scrubber device 10 is adapted for use in several operating modes to accommodate optimum positional control and manipulation of the device according to the specific cleaning task to be performed.

The pool surface scrubber device 10 of the present invention is shown in more detail in FIGS. 2–9. More specifically, with reference to FIGS. 2 and 3, the scrubber device 10 comprises a relatively compact housing defined by matingly shaped upper and lower housing shells 22 and 24 which are conveniently constructed from a lightweight and relatively inexpensive molded plastic or the like. These housing shells 22 and 24 cooperatively define a forward housing head 26 preferably having sufficient lateral span to overlie a pair of the scrubber members 18, as viewed in FIG. 3. The shell components 22 and 24 further define a relatively narrow housing handle 28 projecting rearwardly a short distance from a generally laterally centered position on the head 26.

In general terms, the handle 28 of the scrubber device housing is adapted for convenient connection to the pressurized water supply 20 and further to accommodate the desired multiple operational modes of the scrubber device 10, as will be described in more detail. Water under pressure coupled to the handle 28 is communicated into the interior of the housing head 26 for driving a water-powered drive means to rotate the scrubber members 18. Manipulation of the scrubber device in the selected operational mode permits the scrubber members 18 to be applied directly to a desired pool wall or floor surface in a manner achieving a vigorous scrubbing action.

More specifically, as shown best in FIGS. 7–9, the housing handle 28 carries connector means such as a standard hose fitting 30 to accommodate rapid connection and disconnection to the end of a garden hose 32 (FIG. 1) or the like which is coupled in turn to the supply of water under pressure. Such pressurized water is communicated through the hose fitting 30 and further through an appropriate conduit 34 within the handle 28. The pressurized water flows through this conduit 34 to a narrow cross section jet port 36 formed within the housing head 26, and through which the pressurized water is discharged at substantial velocity into the interior of the head 26.

Water discharged under pressure into the housing head 26 is applied directly against cup-shaped vanes 37 of a water turbine wheel 38. This water turbine wheel 38 is supported within the head 26 by appropriate bearing means for relatively low friction rotational movement in response the driving action of water discharged through the jet port 36. This rotational driving movement of the turbine wheel 38 is transmitted through an appropriate train of reduction gear elements referred to generally by the reference numeral 40 (FIGS. 7 and 8) for rotatably driving a pair of parallel drive spindles 42. These drive spindles 42 are also supported by appropriate bearing means within the head 26 for relatively low friction rotation and include lower drive ends 42' protruding downwardly from the underside of the housing head 26. The specific design and construction of the reduction gear elements 40 will be chosen to provide a desired drive spindle rotational speed in response to the anticipated water pressure and flow rate, for example, when the pressurized water supply comprises a standard domestic water supply having a pressure on the order of about 40 psi or more. Water outlet vents 44 are formed in the head 26 at convenient positions displaced substantially from the jet port 36 to permit outflow of water from the head 26 while insuring intimate driving interaction of pressurized water with the turbine wheel 38.

The lower drive ends 42' of the drive spindles 42 are conveniently provided with a noncircular cross sectional shape, such as the illustrative hexagonal configuration. With this geometry, the scrubber members 18 are provided with open-bored hubs 46 (FIG. 3) having a mating noncircular geometry to insure positive driving of the scrubber members by said spindles. As shown best in FIGS. 3 and 8, in one preferred form, the driven hub 46 of each scrubber member 18 is formed as a portion of a base disk 48 which supports in turn the appropriate scrubber components such as brush bristles 50 or the like. A retention clip 52 is seatable within a groove 54 in each drive spindle end 42' to removably lock the scrubber members onto the associated drive spindle. In this regard, it will be understood that the scrubber members are removable and may be provided in interchangeable styles, for examples, brushes, abrasive pads, etc. With two drive spindles 42 as shown in the illustrative drawings, a pair of the scrubber members 18 are provided in side-by-side relation and are conveniently driven in opposite rotational directions, as depicted by arrows 56 in FIG. 7; a forward guard 58 (FIG. 3) is conveniently provided between the base disks 48 of the two scrubber members 18 to prevent entrapment of fingers or the like therebeween.

Figure 2:
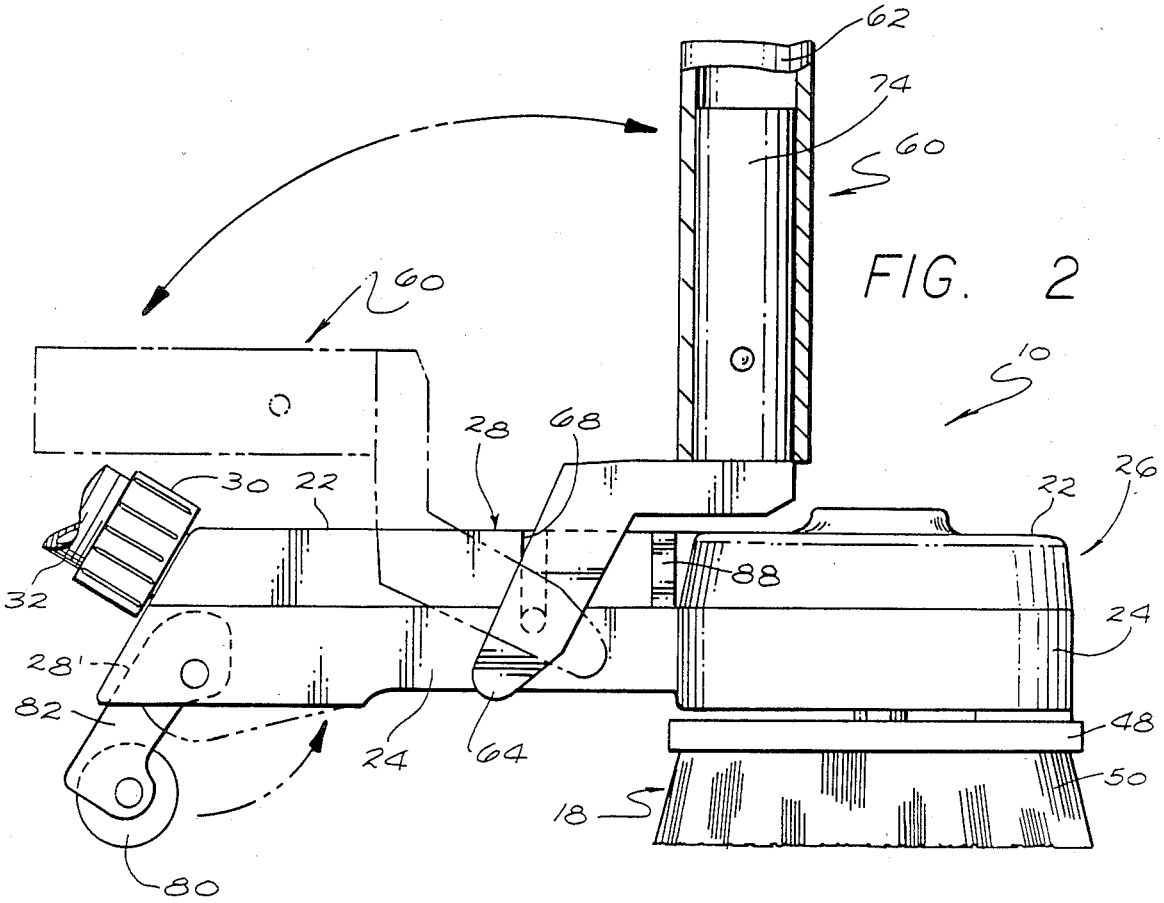
FIG. 2 is an enlarged side elevation view of the pool scrubber device.
Figure 3:
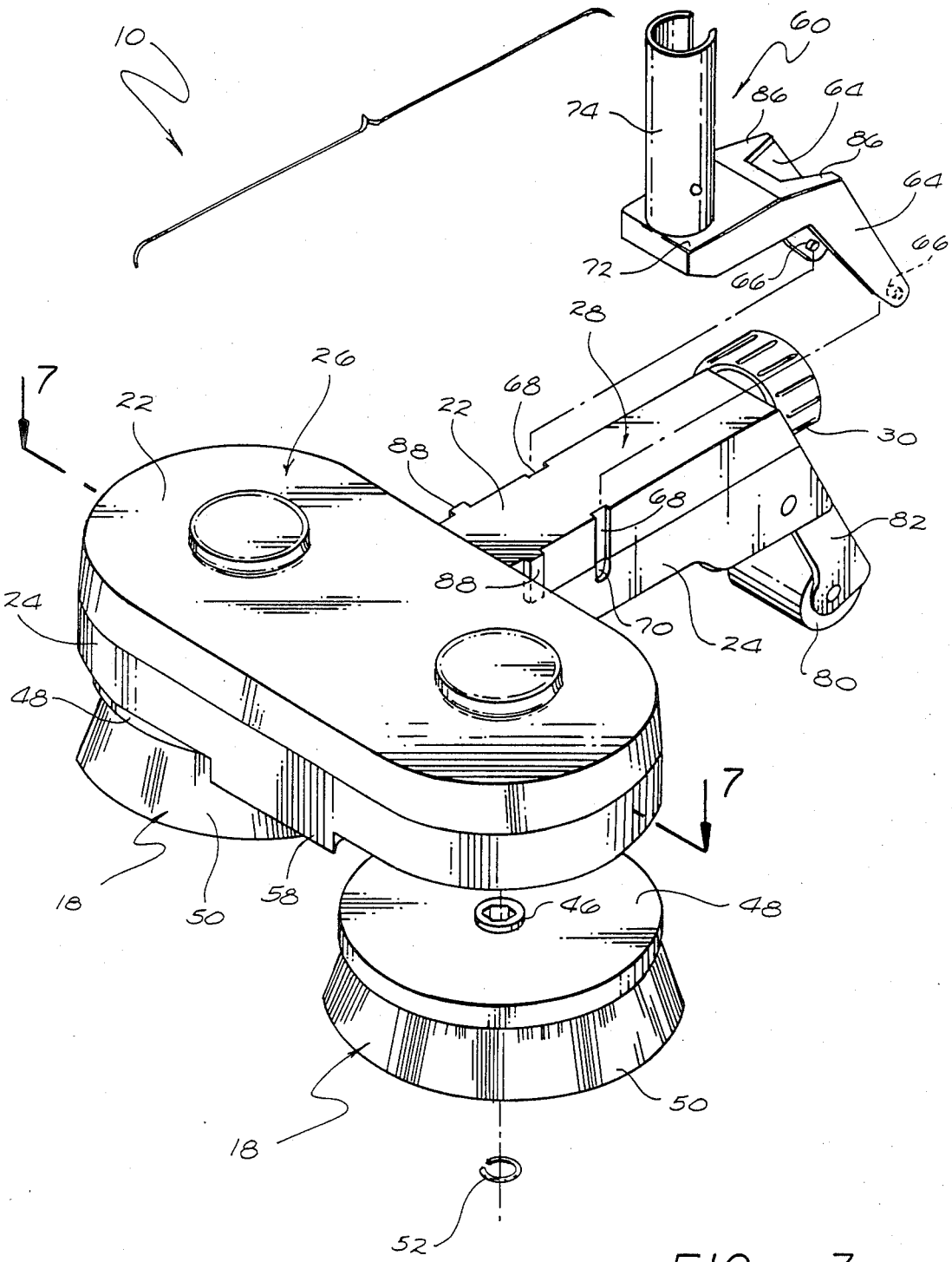
FIG. 3 is an exploded perspective view illustrating construction and assembly of the pool scrubber device.

In one primary operational mode, as shown in FIGS. 1–3, a mounting yoke 60 is installed onto the scrubber device 10 to permit facilitated manipulation by use of a standard pool service utility pole 62. More particularly, the mounting yoke 60, which may also be formed from lightweight molded plastic or the like, includes a pair of downwardly extending legs 64 spaced apart a sufficient distance for straddled mounting onto the handle 28 of the scrubber device. This mounting is achieved by means of inwardly directed pivot pins 66 on the inboard sides of the yoke legs 64, wherein these pins 66 are receivable into ramped cam tracks 68 recessed into opposite sides of the handle 28. Downward pressing motion of the pivot pins 66 along the cam tracks 68 causes those pins 66 to spread slightly and then fit with a snaplike action into transversely aligned recessed seats or holes 70 formed in opposite sides of the handle 28.

In the orientation shown in FIGS. 2 and 3, the upper ends of the mounting yoke legs 64 are joined to a forwardly extending plate 72 which in turn supports an upright cylindrical member 74 sized for sliding reception into the end of the pool service utility pole 62. A conventional lock clip 76 (shown best in FIG. 5) or the like is provided within the cylindrical member 74 for locking engagement with the utility pole 62, all in a well known manner.

With the mounting yoke 62 oriented as viewed in FIGS. 2 and 3, the mounting yoke is pivotally movable relative to the handle 28 through an angle of at least about ninety degrees, thereby pivoting the upright cylindrical member 74 between generally vertical and generally horizontal orientations as viewed in FIG. 2 respectively in solid and dotted lines. This permits convenient manipulation of the scrubber device 10 by a person standing, for example, on a pool deck 78 and using the utility pole 62 to move the scrubber device with smooth transition between generally vertical wall surfaces 12 and generally horizontal floor surfaces 14 of a swimming pool.

For enhanced scrubber device stability during such manipulation for cleaning purposes, a stabilizer wheel 80 is positioned generally at the distal end of the housing handle 28 for providing an additional support surface contacting the pool surface. The mounting yoke 60 is connected to the handle 28 at a position generally intermediate between the scrubber members 18 and the stabilizer wheel 80 such that smooth and stable scrubber device manipulation results. Conveniently, this stabilizer wheel 80 is supported on a bracket 82 which is pivoted onto the handle 28 to project downwardly and rearwardly from the handle, whereby pressing motion of the scrubber device against a pool surface effectively presses the bracket 82 against a rear handle wall portion 28' (FIG. 9) to prevent bracket movement to an alternative substantially concealed position within a lower handle recess 84 (FIG. 9).

The position of the mounting yoke 60 can be reversed as viewed in FIGS. 4–6 to accommodate scrubber device use in an alternative operational mode. More specifically, in this reversed condition, the yoke legs 64 can be oriented to project upwardly and forwardly from the recessed handle seats 70 to position a pair of lock ribs 86 on the yoke plate 72 in locking engagement against the forward sides of outwardly projecting lock lands 88 on the handle 28. Accordingly, in this position, pivoting motion of the mounting yoke 60 relative to the handle 28 is substantially prevented, with the mounting yoke cylindrical member 74 projecting above the head 26 in generally parallel relation with the handle 28. Appropriate connection of the mounting yoke to the utility pole 62 in this orientation thus supports the scrubber device in a sturdy nonpivoting manner, as may be required, for example, in vigorously scrubbing a specific vertical pool wall surface.

In another alternative operational mode, as viewed in FIG. 10, the handle 28 of the scrubber device 10 may be grasped manually for direct manual manipulation over pool surfaces while the scrubber members 18 are rotatably driven. In this mode, the stabilizer wheel 80 and the associated bracket 82 are normally pivoted to the concealed position viewed in FIG. 9, with a detent ball and recess 90 cooperatively locking the stabilizer wheel and bracket in this position. In addition, if desired, the mounting yoke 60 can be removed from the handle.

The improved scrubber device 10 of the present invention thus provides a relatively simple yet highly versatile product for applying a vigorous scrubbing action to the floor and wall surfaces of a swimming pool or the like. The scrubber device 10 is constructed from relatively simple and inexpensive materials and is easily operated in various operational modes to provide the desired scrubbing action.

A variety of further modifications and improvements to the scrubber device of the invention will be apparent to those skilled in the art. Accordingly, no limitation on the invention is intended by way of the description and drawings, except as set forth in the appended claims.

What is claimed is:

1. A scrubber device for cleaning surfaces of a swimming pool or the like, said scrubber device comprising:

a housing;

scrubber means supported by said housing;

drive means within said housing for rotatably driving said scrubber means;

means for connecting said housing to a supply of water under pressure for powering said drive means for rotatably driving said scrubber means; and yoke means mounted on said housing for use in manipulating the scrubber device relative to a surface to be cleaned, said yoke means being positionable on said housing in a selected one of first and second positions, said yoke means being pivotally movable relative to said housing in said first position and being substantially locked against pivoting motion relative to said housing in said second position;

said housing defining a head having said drive means encased therein and a handle, said yoke means being removably mounted on said handle, whereby the scrubber device is operable with said yoke means in the selected one of said first and second positions and further with said yoke means removed from said handle upon manual grasping of said handle.

2. The scrubber device of claim 1 wherein said yoke means is pivotally movable relative to said housing in said first position through an angle of at least about ninety degrees.

3. The scrubber device of claim 2 wherein said yoke means includes lock means for releasably locked connection to a pool service utility pole.

4. The scrubber device of claim 1 wherein said scrubber means comprises a pair of scrubber brushes.

5. The scrubber device of claim 1 wherein said drive means includes a water turbine wheel and reduction drive gear elements within said housing.

6. A scrubber device for cleaning surfaces of a swimming pool or the like, said scrubber device comprising:

a housing including a stabilizer wheel;

scrubber means supported by said housing;

drive means for connecting said housing to a supply of water under pressure for powering said drive means for rotatably driving said scrubber means; and yoke means mounted on said housing for use in manipulating the scrubber device relative to a surface to be cleaned, said yoke means being positionable on said housing generally between said stabilizer wheel and said scrubber means in a selected one of first and second positions, said yoke means being pivotally movable relative to said housing in said first position and being substantially locked against pivoting motion relative to said housing in said second position.

7. The scrubber device of claim 6 wherein said stabilizer wheel is movable between a deployed position extending outwardly from said housing and a retracted position substantially within a recess formed in said housing.

8. The scrubber device of claim 7 further including means for releasably retaining said stabilizer wheel in said retracted position.

9. A scrubber device for cleaning surfaces of a swimming pool or the like, said scrubber device comprising:

a housing;

scrubber means supported on said housing;

drive means within said housing for rotatably driving said scrubber means;

means for connecting said housing to a supply of water under pressure for powering said drive means for rotatably driving said scrubber means; and yoke means mounted on said housing for use in manipulating the scrubber device relative to a surface to be cleaned, said yoke means being positionable on said housing in a selected one of first and second positions, said yoke means being pivotally movable relative to said housing in said first position and being substantially locked against pivoting motion relative to said housing in said second position;

said yoke means including a pair of depending legs having inwardly directed pins formed thereon, said housing including a pair of ramped cam tracks each associated with an adjacent recessed seat, said pins on said legs being receivable along said cam tracks to spread said legs and for reception of said pins into said seats to removably mount said yoke means on said housing.

10. The scrubber device of claim 9 wherein said yoke means is removably mountable on said housing in said first and second positions by reversably mounting said legs relative to said cam tracks.

11. The scrubber device of claim 9 wherein said yoke means and said housing include cooperating lock means for preventing pivoting movement of said yoke means relative to said housing when said yoke means is mounted on said housing in said second position.

12. A scrubber device for use in cleaning surfaces of a swimming pool or the like, said scrubber device comprising;

a housing;

scrubber means supported by said housing;

drive means within said housing for movably driving said scrubber means; and yoke means mountable on said housing for use in manipulating said scrubber means relative to the surface to be cleaned, said yoke means being reversibly positionable on said housing in a first position permitting pivoting movement of said yoke means relative to said housing and a second position substantially preventing pivoting movement of said yoke means relative to said housing, said yoke means being removable from said housing to permit changing of the position of said yoke means between said first and second positions.

13. The scrubber device of claim 12 further including a stabilizer wheel supported by said housing and movable between a deployed position and a retracted position disposed substantially within a recess formed in said housing.

14. A scrubber device for use in cleaning surfaces of a swimming pool or the like, said scrubber device comprising:

a housing defining a head and a handle projecting outwardly from one side of said head;

water-powered drive means within said head;

means for coupling said water-powered drive means to a source of water under pressure;

at least one drive spindle coupled in driven relation to said water-powered drive means and projecting outwardly from said head;

a scrubber member removably mounted on said drive spindle;

a mounting yoke adapted for releasably locked connection to a pool service utility pole, said mounting yoke and said handle including cooperating mounting means for removably mounting said yoke onto said handle in a selected one of first and second positions, said mounting means permitting pivoting movement of said yoke through an angle of at least about ninety degrees when said yoke is in said first position and substantially preventing pivoting movement of said yoke when said yoke is in said second position.

15. The scrubber device of claim 14 wherein said handle includes a hose fitting for releasable connection to the source of water under pressure.

16. The scrubber device of claim 15 wherein said mounting means includes means for reversably mounting said yoke on said handle in said first and second positions.

17. The scrubber device of claim 14 wherein the device includes a pair of said drive spindles projecting outwardly from said head, and a pair of said scrubber members removably mounted on said drive spindles.

18. The scrubber device of claim 14 wherein said mounting means comprises a pair of legs on said yoke, means for pivotally mounting said legs relative to said handle, at least one lock rib on said yoke and at least one lock land on said handle, said lock rib and said lock land being interengageable to prevent pivoting movement of said yoke relative to said handle when said yoke is mounted on said handle in said second position, said lock rib and said lock land being out of engagement when said yoke is mounted on said handle in said first position.

19. The scrubber device of claim 14 further including a stabilizer wheel mounted generally at the distal end of said handle, said stabilizer wheel being movable between a deployed position and a retracted position disposed substantially within a recess formed in said handle.

* * * * *